US009702281B2

(12) United States Patent
Newman et al.

(10) Patent No.: US 9,702,281 B2
(45) Date of Patent: Jul. 11, 2017

(54) CONSTANT FRESH AIR CRANKCASE VENTILATION

(71) Applicant: Ford Global Technologies, LLC, Dearborn, MI (US)

(72) Inventors: Christopher William Newman, Farmington Hills, MI (US); Claude Weston Bailey, III, Warren, MI (US); Scott Morton, New Boston, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 132 days.

(21) Appl. No.: 14/821,006

(22) Filed: Aug. 7, 2015

(65) Prior Publication Data

US 2017/0037751 A1 Feb. 9, 2017

(51) Int. Cl.

*F01M 13/04* (2006.01)
*F01M 13/02* (2006.01)
*F01M 13/00* (2006.01)

(52) U.S. Cl.

CPC ..... *F01M 13/023* (2013.01); *F01M 13/04* (2013.01); *F01M 2013/0044* (2013.01)

(58) Field of Classification Search

CPC ..... F01M 13/023; F01M 13/04; F01M 2013/0044
USPC ..... 123/572–574
See application file for complete search history.

(56) References Cited

U.S. PATENT DOCUMENTS

2013/0340732 A1* 12/2013 Pursifull ..... F02M 35/10222 123/572
2014/0116399 A1* 5/2014 Ulrey ..... F02M 25/08 123/520

* cited by examiner

*Primary Examiner* — Marguerite McMahon
(74) *Attorney, Agent, or Firm* — LeClairRyan

(57) ABSTRACT

A method and apparatus for providing constant fresh air ventilation to the engine crankcase are disclosed. The apparatus is adapted for use with an internal combustion engine having a crankcase, an intake manifold and an air input attached to the manifold. The system includes an integrated vacuum actuator connected to the intake manifold, an actuator duct positioned between the vacuum actuator and the air input, an air-from-oil separator associated with the crankcase, a separator duct and separator control valve positioned between the separator and the intake manifold, and a bypass duct and bypass control valve between the separator duct and the actuator duct. The air input comprises an initial intake pipe and an intermediate intake pipe with the intermediate intake pipe being positioned between the initial intake pipe and the intake manifold. A fresh air control pipe and regulator assembly are attached to the intermediate intake pipe.

20 Claims, 2 Drawing Sheets

CONSTANT FRESH AIR CRANKCASE VENTILATION

TECHNICAL FIELD

The disclosed inventive concept relates generally to crankcase ventilation in internal combustion engines. More particularly, the disclosed inventive concept relates to a method and system for crankcase ventilation in which an integrated vacuum actuator provides a constant and significant amount of fresh air to the engine crankcase independent of engine load conditions. In addition to the integrated vacuum actuator which is attached to the engine's intake manifold, the method and system incorporates an air-from-oil separator, a plurality of check valves, a flow control valve, and associated fluid ducts.

BACKGROUND OF THE INVENTION

During the combustion stage of the air-fuel mixture within an internal combustion engine, exhaust gases are created that exit the engine via the exhaust manifold during engine operation. However, not all gases exit the engine at this time. Some of these gases are forced to bypass the piston and enter the crankcase because of the pressure created during combustion of the air-fuel mixture.

Relief of these collected gases is necessary to avoid damage to engine gaskets caused by the extra crankcase pressure. Such damage resulted in oil leakage. An early and direct solution to the build-up of exhaust gases in the crankcase was simply to exhaust the collected gases directly to the atmosphere via, for example, a road draft tube. However, this is an undesirable solution to the presence of these gases due to the negative environmental impact generated by these unburned hydrocarbon emissions.

As an alternative, these gases can be re-introduced into the engine by evacuating them from the crankcase and adding them to the air-fuel mixture entering the engine via the intake manifold. Oil separators are known for this purpose.

A common solution to separating oil from air includes the use of a mesh filter in which oil droplets are trapped in the mesh (typically composed of a microfiber) and air is allowed to pass through. Another simple approach to separating oil from air is to provide a tube through which passes the recycled gas. The tube has holes formed on its side. Air passes through the holes and oil droplets, being heavier, fall to the bottom of a reservoir. A moving unit, such as a centrifuge, may also be used to separate oil from the air. The separated oil is directed back into the crankcase.

A very typical solution has been to have the crankcase gases flow from the crankcase to the intake manifold by way of a positive crankcase ventilation ("PCV") system as regulated by a valve located along the PCV path. According to one PCV example, the path for the PCV begins at the valve cover and ends at the intake manifold. During engine operation, the PCV valve increases a restriction between the intake system and the crankcase in periods of higher intake manifold vacuum, thus reducing the restriction between the intake manifold and the crankcase during periods of lower intake manifold vacuum. According to this system, a slight vacuum is maintained in the engine crankcase thereby drawing hydrocarbons from the engine crankcase and directing them into the engine intake system.

It is a challenge for current gasoline engines with PCV systems to provide a significant amount of fresh air into the crankcase at high engine load conditions. With the automotive industry shift to downsize engines in heavier vehicles, engines could spend more time at higher engine load conditions during road load speeds for a significant amount of time. The PCV system has a null to insignificant amount of fresh air that enters the crankcase at higher engine load conditions. A certain ratio of fresh air-to-engine blow-by is required to prevent the acceleration of engine oil degradation which will turn the engine oil to sludge. Accelerated engine oil degradation reduces engine oil life which increases the oil change frequency requirement for the vehicle owner. If the manufacture-recommended engine oil change frequency is not followed, then the engine oil will turn to sludge and cause damage to the engine.

Accordingly, as in so many areas of vehicle technology, there is room for improvement related to the use and operation of positive crankcase ventilation systems associated with the internal combustion engine.

SUMMARY OF THE INVENTION

To avoid the problems associated with the prior art, the disclosed inventive concept provides a method and apparatus for providing constant fresh air ventilation to the engine crankcase. By providing such constant ventilation, the problems associated with known approaches are overcome.

More particularly, the disclosed inventive concept is adapted for use with an internal combustion engine having a crankcase, an intake manifold and an air input attached to the manifold. The disclosed inventive concept includes an integrated vacuum actuator connected to the intake manifold, an actuator duct positioned between the vacuum actuator and the air input, an air-from-oil separator associated with the crankcase, a separator duct and separator control valve positioned between the separator and the intake manifold, and a bypass duct and bypass control valve between the separator duct and the actuator duct.

The air input comprises an initial intake pipe and an intermediate intake pipe with the intermediate intake pipe being positioned between the initial intake pipe and the intake manifold. A fresh air control pipe and regulator assembly is attached to the intermediate intake pipe. The actuator duct is attached to the initial intake pipe of the air input.

The bypass duct connects to the separator duct at a location between the separator and the intake manifold. The separator duct control valve is positioned between the intake manifold and the connection location of the bypass duct with the separator duct.

An incoming air compressor is fitted between the initial intake pipe and the intermediate intake pipe. An exhaust manifold is attached to the engine and an exhaust pipe is attached to the exhaust manifold. A turbine is attached to the exhaust manifold and the compressor.

In operation, a low-output part throttle mode is established by moving the separator valve to its open position and moving the bypass valve to its closed position. Conversely, a high-output boost mode is established by moving the separator valve to its closed position and moving the bypass valve to its open position.

The use of the integrated vacuum actuator according to the disclosed inventive concept is an important functional difference between the solution set forth herein and current systems for crankcase ventilation. The solution according to the disclosed inventive concept provides a constant and significant amount of fresh air to the engine crankcase independent of engine load conditions. The disclosed inventive concept decelerates the rate of engine oil degradation, extends engine oil life, and reduces the number of engine oil changes required for the life of the vehicle, thus reducing operating costs that would otherwise be experienced by the vehicle owner. In addition, the need for a second air-from-oil separator (AOS) is eliminated, which means engine manufacturing cost is also reduced.

The above advantages and other advantages and features will be readily apparent from the following detailed description of the preferred embodiments when taken in connection with the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention wherein.

DETAILED DESCRIPTION OF THE PREFERRED EMBODIMENT

Figure 1:
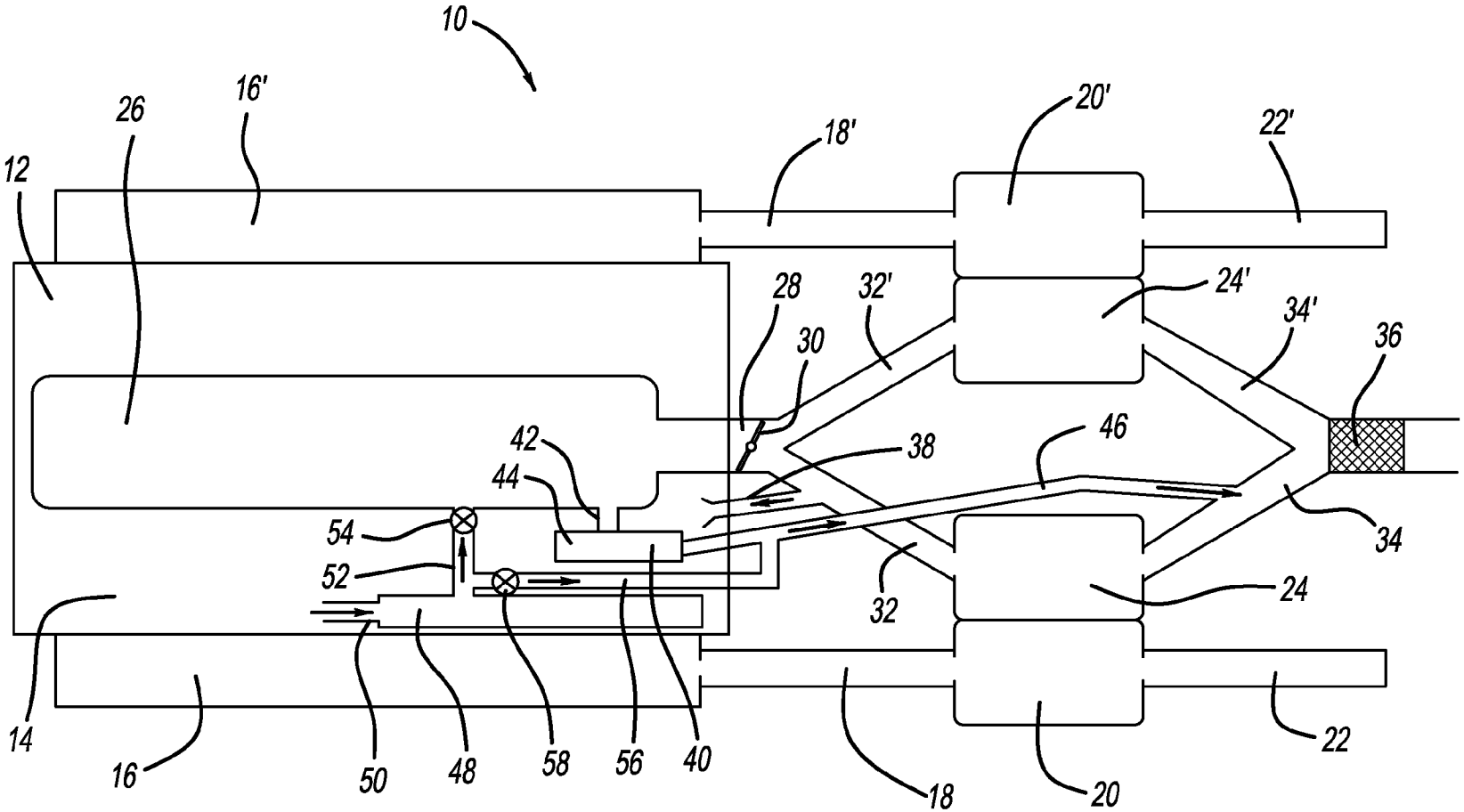
FIG. 1 is a diagrammatic illustration of a constant fresh air crankcase ventilation system fitted to an internal combustion engine having dual exhausts according to the disclosed inventive concept.

In the following figures, the same reference numerals will be used to refer to the same components. In the following description, various operating parameters and components are described for different constructed embodiments. These specific parameters and components are included as examples and are not meant to be limiting.

In general, the disclosed inventive concept relates to a method and system for providing constant fresh air crankcase ventilation to an internal combustion engine. The system includes an integrated vacuum actuator provides a constant and significant amount of fresh air to the engine crankcase independent of engine load conditions. In addition to the integrated vacuum actuator which is attached to the engine's intake manifold, the method and system incorporates an air-from-oil separator, a plurality of check valves, a flow control valve, and associated hoses.

A constant fresh air crankcase ventilation system according to the disclosed inventive concept is generally illustrated as 10 in FIG. 1. The illustrated constant fresh air crankcase ventilation system 10 is suggestive only and is not intended as being limiting as variations of the system may be made without deviating from either the spirit or the scope of the system.

The constant fresh air crankcase ventilation system 10 is adapted for use with an internal combustion engine 12. The constant fresh air crankcase ventilation system 10 of the disclosed inventive concept may be incorporated into an internal combustion engine of virtually any size, although the crankcase ventilation system 10 is best suited for use on engines having smaller displacements and a lesser number of cylinders.

Figure 2:
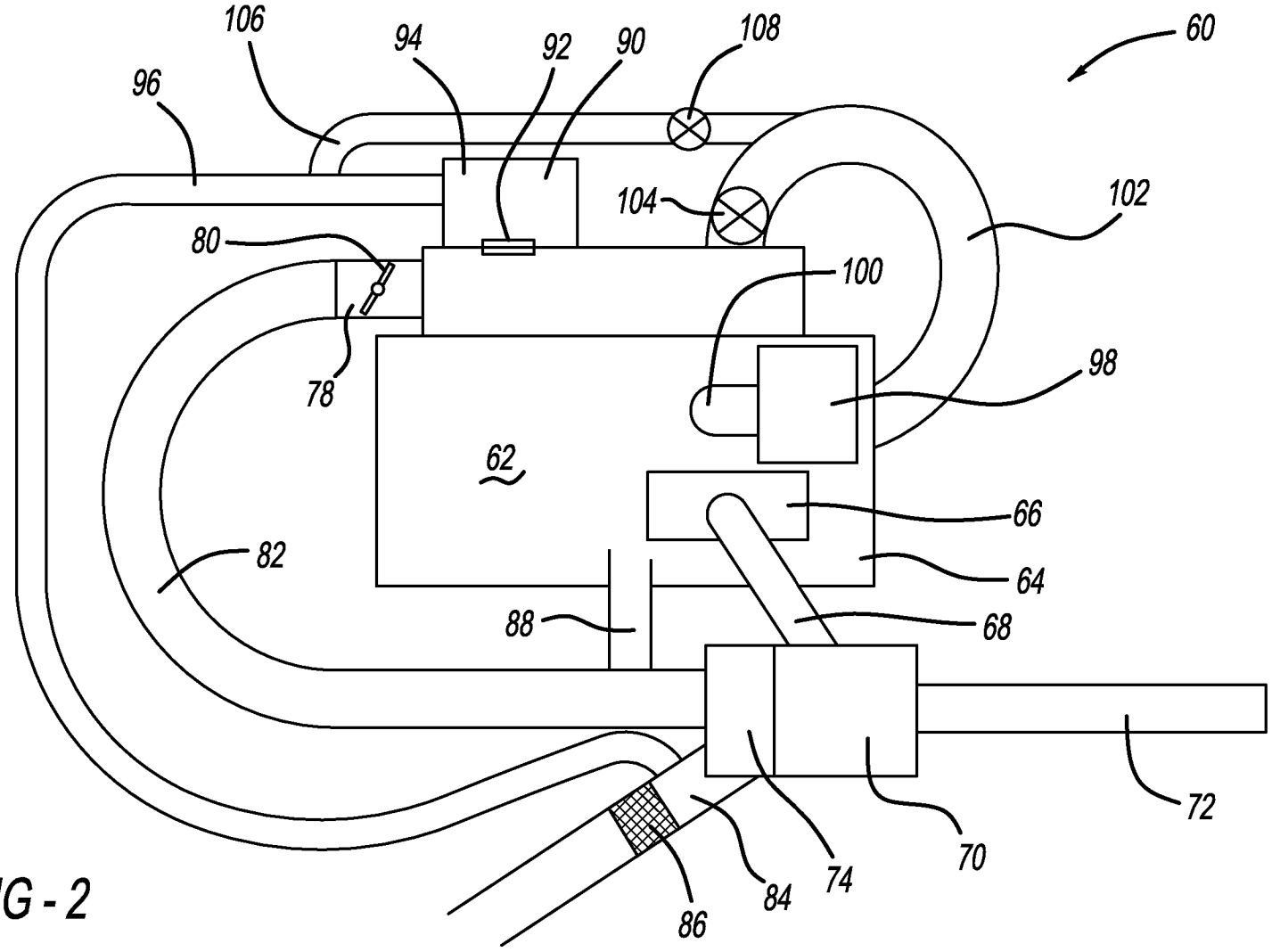
FIG. 2 is a diagrammatic illustration of a constant fresh air crankcase ventilation system fitted to an internal combustion engine having a single exhaust manifold according to the disclosed inventive concept.

The internal combustion engine 12 conventionally includes an engine crankcase 14. Fitted to the internal combustion engine 12 is an exhaust manifold. Dual exhaust manifolds 16 and 16' may be provided as illustrated in FIG. 1, although the crankcase ventilation system 10 of the disclosed inventive concept may be adapted for use as easily with an engine having a single manifold as illustrated in FIG. 2 and as discussed below in relation thereto.

Attached to the exhaust manifold 16 is an intermediate exhaust pipe 18. A turbine 20 is attached to the intermediate exhaust pipe 18. A tailpipe 22 is attached to the turbine 20. Attached to the exhaust manifold 16' is an intermediate exhaust pipe 18'. A turbine 20' is attached to the intermediate exhaust pipe 18'. A tailpipe 22' is attached to the turbine 20'. It should be noted that while the disclosed inventive concept is illustrated as having a turbine for boosting air flow, the use of a turbine in this arrangement is optional. The system of the disclosed inventive concept could as well be used with a normally aspirated intake system.

A turbine compressor 24 is operatively associated with the turbine 20. A turbine compressor 24' is operatively associated with the turbine 20'.

An intake manifold 26 is operatively associated with the internal combustion engine 12. The intake manifold 26 is associated with a throttle body 28 having a movable throttle flap 30. An intermediate intake pipe 32 is fitted between the turbine compressor 24 and the throttle body 28. An intermediate intake pipe 32' is fitted between the turbine compressor 24' and the throttle body 28. An initial intake pipe 34 is fitted between an air filter 36 and the turbine compressor 24. An initial intake pipe 34' is fitted between the air filter 36 and the turbine compressor 24'. A fresh air control input pipe and regulator assembly 38 is fluidly attached to the intermediate intake pipe 32.

A vacuum actuator assembly 40 is integrally attached to the intake manifold 26 at actuator port 42. The actuator assembly 40 includes an integrated vacuum actuator 44 and an actuator duct 46. The actuator duct 46 is fitted between the integrated vacuum actuator 44 and the initial intake pipe 34. The actuator duct 46 provides a vacuum from the integrated vacuum actuator 44 and the initial intake pipe 34.

An air-from-oil separator 48 having a crankcase attachment end 50 is provided. The crankcase attachment end 50 of the air-from-oil separator 48 is attached to the crankcase 14.

A separator-to-intake manifold duct 52 is provided between the air-from-oil separator 48 and the intake manifold 26. The separator-to-intake manifold duct 52 includes a check valve 54. An actuator bypass duct 56 is provided between the separator-to-intake manifold duct 52 and the actuator duct 46. The actuator bypass duct 56 includes a check valve 58.

As a possible variation of the configuration of the constant fresh air crankcase ventilation system 10 adapted for use with a dual exhaust manifold engine shown in FIG. 1 and discussed in conjunction therewith, FIG. 2 illustrates a constant fresh air crankcase ventilation system 60 adapted for use on a smaller engine, such as an engine having a single exhaust manifold.

Referring to FIG. 1, the constant fresh air crankcase ventilation system 60 is adapted for use with a smaller internal combustion engine 62 having, for example, four cylinders. The internal combustion engine 62 conventionally includes an engine crankcase 64.

Fitted to the internal combustion engine 62 is a single exhaust manifold 66. Attached to the exhaust manifold 66 is an intermediate exhaust pipe 68. A turbine 70 is attached to the intermediate exhaust pipe 68. A tailpipe 72 is attached to the turbine 70. A turbine compressor 74 is operatively associated with the turbine 70.

An intake manifold 76 is attached to the internal combustion engine 62. The intake manifold 76 is associated with a throttle body 78 having a movable throttle flap 80. An intermediate intake pipe 82 is fitted between the turbine compressor 74 and the throttle body 78. An input pipe 84 is fitted between an air filter 86 and the turbine compressor 74. A fresh air control input pipe and regulator assembly 88 is fluidly attached to the intermediate intake pipe 82.

A vacuum actuator assembly 90 is integrally attached to the intake manifold 76 at actuator port 92. The actuator assembly 90 includes an integrated vacuum actuator 94 and an actuator duct 96. The actuator duct 96 is fitted between the integrated vacuum actuator 94 and the input pipe 84. The actuator duct 96 provides a vacuum from the integrated vacuum actuator 94 and the input pipe 84.

An air-from-oil separator 98 having a crankcase attachment port 100 is provided. The crankcase attachment port 100 of the air-from-oil separator 98 is attached to the crankcase 64.

A separator-to-intake manifold duct 102 is provided between the air-from-oil separator 98 and the intake manifold 76. The separator-to-intake manifold duct 102 includes a check valve 104. An actuator bypass duct 106 is provided between the separator-to-intake manifold duct 102 and the actuator duct 96. The actuator bypass duct 106 includes a check valve 108.

Operation of the constant fresh air crankcase ventilation system according to the disclosed inventive concept is the same regardless of whether it is adapted to a dual exhaust manifold engine or to a single exhaust manifold engine. Regardless of the embodiment, a constant and significant amount of fresh air is provided to the engine crankcase independent of engine load conditions.

Particularly, when the check valve 54 (104) of the separator-to-intake manifold duct 52 (102) is in its open position and the check valve 58 (108) of the actuator bypass duct 56 (106) is in its closed position, the low-output part throttle mode exists. Under this condition, crankcase gases are sucked from the engine crankcase 14 (64) through the air-from-oil separator 48 (98) by way of the separator-to-intake manifold duct 52 (102) and into the intake manifold 26 (76) due to the intake vacuum.

Conversely, when the check valve 54 (104) of the separator-to-intake manifold duct 52 (102) is in its closed position and the check valve 58 (108) of the actuator bypass duct 56 (106) is in its open position, the high-output boost mode exists. Under this condition, crankcase gases are sucked from the engine crankcase 14 (64) through the air-from-oil separator 48 (98) by way of the actuator bypass duct 56 (106) and into the actuator duct 46 (96) of the actuator assembly 40 (90).

Thus according to the disclosed inventive concept, a constant and significant amount of fresh air is provided to the engine crankcase regardless of mode. In this way the disclosed inventive concept overcomes the challenges faced by known PCV systems and minimizes the risk of early engine oil breakdown and consequent engine failure. The disclosed inventive concept not only finds utility in the automotive industry, but may also be useful in the marine engine industry where boats commonly troll for many hours in cold water creating sludge potential for the engine oil, followed by a high-speed return to the dock. Known PCV systems are highly strained under such operating conditions.

The disclosed inventive concept as set forth above overcomes the challenges faced by known PCV arrangements in a variety of internal combustion engines. Accordingly, one skilled in the art will readily recognize from such discussion, and from the accompanying drawings and claims that various changes, modifications and variations can be made therein without departing from the true spirit and fair scope of the invention as defined by the following claims.

What is claimed is:

1. A constant fresh air crankcase ventilation system for an internal combustion engine having a crankcase and an intake manifold with an input, the system comprising:

an integrated vacuum actuator connected to the manifold;

an actuator duct between said actuator and the input;

an air-from-oil separator associated with the crankcase;

a separator duct and valve between said separator and the manifold; and a bypass duct and valve between said separator duct and said actuator duct.

2. The constant fresh air crankcase ventilation system for an internal combustion engine of claim 1 wherein said valves are check valves.

3. The constant fresh air crankcase ventilation system for an internal combustion engine of claim 1 further including a fresh air control pipe and regulator assembly attached to the input.

4. The constant fresh air crankcase ventilation system for an internal combustion engine of claim 1 wherein said bypass duct connects to said separator duct at a location between said separator and the manifold.

5. The constant fresh air crankcase ventilation system for an internal combustion engine of claim 4 wherein said separator duct valve is positioned between the manifold and the connection location of said bypass duct with said separator duct.

6. The constant fresh air crankcase ventilation system for an internal combustion engine of claim 1 wherein said actuator duct is a vacuum duct in which a vacuum is created from the input to said actuator.

7. A constant fresh air crankcase ventilation system comprising:

an engine having a crankcase, an intake manifold, and an air input attached to said manifold;

an integrated vacuum actuator connected to said manifold;

an actuator duct between said actuator and said input;

an air-from-oil separator associated with said crankcase;

a separator duct and control valve between said separator and said manifold; and a bypass duct and control valve between said separator duct and said actuator duct.

8. The constant fresh air crankcase ventilation system for an internal combustion engine of claim 7 wherein said air input comprises an initial intake pipe and an intermediate intake pipe, said intermediate intake pipe being positioned between said initial intake pipe and said intake manifold.

9. The constant fresh air crankcase ventilation system for an internal combustion engine of claim 8 further including a fresh air control pipe and regulator assembly attached to said intermediate intake pipe.

10. The constant fresh air crankcase ventilation system for an internal combustion engine of claim 8 wherein said actuator duct is attached to said initial intake pipe of said input.

11. The constant fresh air crankcase ventilation system for an internal combustion engine of claim 8 further including a compressor fitted between said initial intake pipe and said intermediate intake pipe.

12. The constant fresh air crankcase ventilation system for an internal combustion engine of claim 11 further including an exhaust manifold attached to said engine, an exhaust pipe attached to said exhaust manifold, and a turbine attached to said exhaust pipe and to said compressor.

13. The constant fresh air crankcase ventilation system for an internal combustion engine of claim 7 wherein said bypass duct connects to said separator duct at a location between said separator and said intake manifold.

14. The constant fresh air crankcase ventilation system for an internal combustion engine of claim 13 wherein said separator duct control valve is positioned between said intake manifold and the connection location of said bypass duct with said separator duct.

15. The constant fresh air crankcase ventilation system for an internal combustion engine of claim 7 wherein said actuator duct is a vacuum duct in which a vacuum is created from said input to said actuator.

16. A method of providing constant fresh air crankcase ventilation for an internal combustion engine, the method comprising the steps of:

forming an engine having a crankcase and an intake manifold with an input, an integrated vacuum actuator connected to said manifold, an actuator duct between said actuator and said input, an air-from-oil separator associated with said crankcase, a separator duct and separator valve between said separator and said manifold, and a bypass duct and bypass valve between said separator duct and said actuator duct;

establishing a low-output part throttle mode by moving said separator valve to its open position and moving said bypass valve to its closed position; and establishing a high-output boost mode by moving said separator valve to its closed position and moving said bypass valve to its open position.

17. The method of providing constant fresh air crankcase ventilation of claim 16 including the step of providing a fresh air control pipe and regulator assembly attached to the input.

18. The method of providing constant fresh air crankcase ventilation of claim 16 including providing an intake booster with said input.

19. The method of providing constant fresh air crankcase ventilation of claim 16 including the step of positioning said separator duct valve between said intake manifold and the connection location of said bypass duct with said separator duct.

20. The method of providing constant fresh air crankcase ventilation of claim 16 wherein said actuator duct is a vacuum duct in which a vacuum is created from said input to said actuator.

* * * * *